US006898868B2

(12) United States Patent
Vermeulen

(10) Patent No.: US 6,898,868 B2
(45) Date of Patent: May 31, 2005

(54) WRAPPING IRREGULARLY SHAPED OBJECTS IN PRODUCTION LINE

(75) Inventor: Norbert Vermeulen, Kleve (DE)

(73) Assignee: MSK-Verpackungs-Systeme Gesellschaft mit beschrankter Haftung, Kleve (DE)

( * ) Notice: Subject to any disclaimer, the term of this patent is extended or adjusted under 35 U.S.C. 154(b) by 0 days.

(21) Appl. No.: 10/416,744

(22) PCT Filed: Nov. 6, 2001

(86) PCT No.: PCT/EP01/12807

§ 371 (c)(1),
(2), (4) Date: Jun. 6, 2003

(87) PCT Pub. No.: WO02/40352

PCT Pub. Date: May 23, 2002

(65) Prior Publication Data

US 2004/0107599 A1 Jun. 10, 2004

(30) Foreign Application Priority Data

Nov. 14, 2000 (DE) ..... 100 56 461

(51) Int. Cl.[7] ..... F26B 13/00

(52) U.S. Cl. ..... 34/528; 34/550; 34/560; 53/492; 219/382; 219/427

(58) Field of Search ..... 34/380, 382, 427, 34/438, 105, 573, 201, 218, 526, 528, 550, 560; 222/1, 143; 156/213, 286; 53/492, 381.5

(56) References Cited

U.S. PATENT DOCUMENTS

| | | | | | |
|---|---|---|---|---|---|
| 3,801,268 | A | * | 4/1974 | Amo | 432/225 |
| 4,228,345 | A | * | 10/1980 | Stricker et al. | 219/388 |
| 4,738,082 | A | * | 4/1988 | Saitoh | 53/557 |
| 5,009,057 | A | * | 4/1991 | Wilkinson | 53/439 |
| 5,098,498 | A | * | 3/1992 | Hale et al. | 156/213 |
| 5,400,102 | A | * | 3/1995 | Alwitt | 396/535 |
| 5,440,102 | A | * | 8/1995 | Pena | 219/388 |

FOREIGN PATENT DOCUMENTS

| | | | |
|---|---|---|---|
| DE | 28 04 941 | 8/1979 | |
| DE | 38 21 164 | 1/1989 | |
| JP | 06329127 | * 11/1994 | B65B/53/02 |
| JP | 10114309 | * 5/1998 | B65B/53/02 |

* cited by examiner

*Primary Examiner*—Stephen Gravini
(74) *Attorney, Agent, or Firm*—Herbert Dubno; Andrew Wilford

(57) ABSTRACT

A hood-shaped foil covering an object is heat-shrunk around the object by displacing the object covered by the foil along a generally straight path in a transport direction past a stationary heater which is directed at an acute angle to the direction. The position of the object relative to the heater as it passes the heater in the direction is detected and heat is projected from the heater at the acute angle to the direction at the object as it passes at a rate varied in accordance with the detected position of the object relative to the heater.

16 Claims, 4 Drawing Sheets

Fig. 2
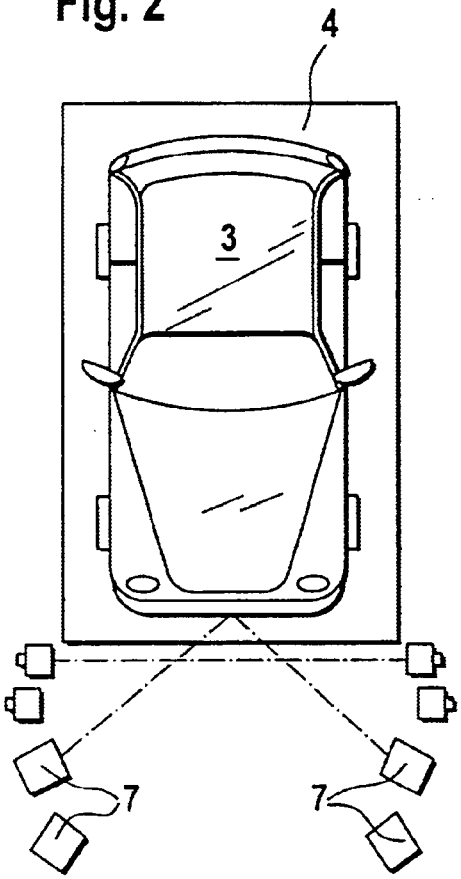
Fig. 3
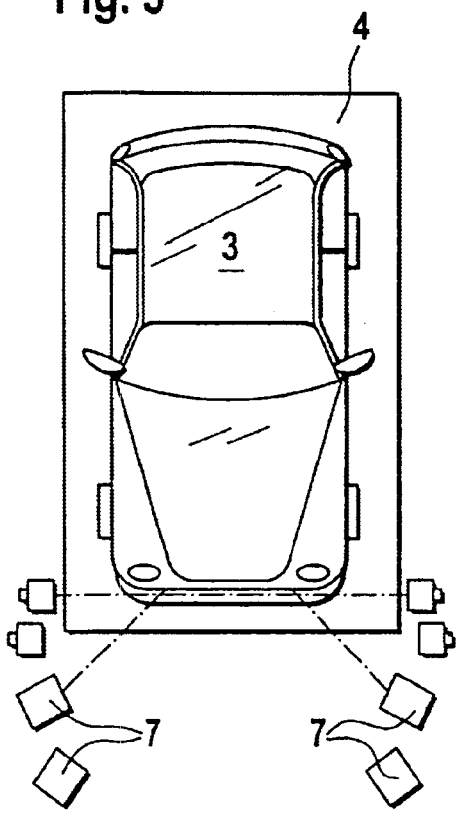
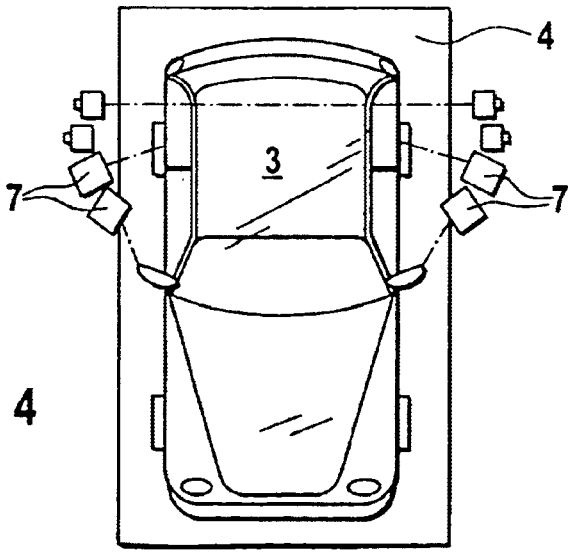
Fig. 4

WRAPPING IRREGULARLY SHAPED OBJECTS IN PRODUCTION LINE

CROSS REFERENCE TO RELATED APPLICATIONS

This is the US national phase of PCT application PCT/EP01/12807 filed 6 Nov. 2001, published 23 May 2002 as WO 02/40352, and claiming the priority of German application 100 56 461.5 filed 14 Nov. 2000.

FIELD OF THE INVENTION

The invention relates to a method and apparatus for the multisided wrapping of irregularly shaped objects, as for example automobiles, with a heat-shrinkable foil serving as transport protection, the foil being made generally hood-shaped to conform to the object, being fitted over the object, and subsequently being shrink-fitted by heat action tightly to the vehicle. Such a method is e.g. described in DE 38 21 164.

BACKGROUND OF THE INVENTION

Such methods are known in practice that serve among other purposes to protect automobiles from dirt and damage, in particular to the paint, as they are shipped from the production site to the delivery location. With automobiles this replaces the known protective method of using a wax coating for protection. This layer of wax is difficult to remove at the delivery locations and presents environmental problems in its disposal.

A disadvantage of the method of using a foil for transport protection is that fitting the foil and shrinking it in some locations on the object or car takes quite some time, entailing considerable costs while this method from a commercial viewpoint is thus not a usable alternative to the known wax method. In the shrinking of such pieces DE 28 04 941 for instance teaches control of the heat output in dependence on the position of the object being wrapped.

OBJECT OF THE INVENTION

It is an object of the invention to avoid the above-discussed disadvantages and to provide a method for the multisided wrapping of irregularly shaped objects, as for example automobiles, with a heat-shrinkable foil serving as transport protection, whereby the multisided wrapping can be done in a quick cycle.

SUMMARY OF THE INVENTION

This object is attained by a method for the multisided wrapping of irregularly shaped objects, e.g. automobiles, with a heat-shrinkable foil serving as transport protection, the foil being shaped as a hood fitted to the object, being fitted over the object, and then being made to fit snugly by application of heat from a heater, wherein, for heating different regions of the object as for example different zones of a vehicle front or rear, at least a part of the heat applied is directed at an angle to the transport direction of the conveyor by a heater whose position and orientation are fixed, the heating output being changed in dependence on the actual transport position of the object for the portion being heated. In this manner parts that must move into the conveyor when heating and thus require considerable spacing between succeeding objects are not needed so that the cycling time can be shortened by the simple expedient of closely spacing the objects. On the other hand wear is reduced and likelihood of accidents drops, since there are no mechanical movements inside the heating zone and thus no parts of the apparatus, as for example gas lines for the heater or the like are worn out by substantial to-and-fro movement at high temperature of the heater so that failure and accidents are avoided. The heaters are generally fixed with respect to position and orientation.

Preferably in order to heat uniformly and to avoid overheating the foil and the object, the heat is varied according to the shape and/or the composition of the region of the object being heated by further adjustment of the output of the heater so that a generally uniform shrinking of the foil is achieved and it can be made smaller because no reserve parts need be provided and a smaller load is presented. In addition the object being wrapped is subjected to a smaller thermal load and reduced stress from the shrunk foil. In particular thermally and/or mechanically sensitive regions can be subjected to less thermal and/or mechanical stress as a result of the controlled heating, with less shrinking. Heat control is set to avoid overheating the foil or the object and either the shape or the composition of the region being heated is taken into account.

This can for example reduce the heating of the thermally sensitive tires of the vehicle as well as the normally overheated side mirrors that are closer to the heater.

To this end vertically orientable and positionable sensors are provided, e.g. horizontally and vertically adjustable light curtains, which reduce heat output when an object is in their detection field. To this end the arrangement of the light curtains, with respect to position and aiming direction, relative to the heater are variable.

The invention also relates to an apparatus for carrying out the method with a conveyor that moves the object through the apparatus and at least one heater for heating the foil to shrink it to fit the object, wherein in order the heat different regions of the object, as for example different zones of a vehicle front or rear, at least one heater is arranged laterally at an angle to the transport direction of the conveyor and is fixed with respect to position and orientation, and the heater output is controlled in dependence on the actual transport position of the object. In this manner the heater can be spaced relatively far from the object, but with increased heater output can still act on the outermost and most remote part, e.g. the vehicle front, whereas at a closer spacing the output is reduced to reach the center of the vehicle front or the inner edge of the vehicle side. Hence the heaters can be generally fixed with regard to their position and orientation.

The conveyor can be a plate-type belt on which the automobiles to be wrapped are set so that the wheels of the vehicle do not rotate on movement through the heating apparatus.

According to the invention at least one heater is vertically oriented so that a single heater can direct hot air over virtually the entire side of the object. Even a generally only vertically aimed heater is possible.

In addition heaters can be provided to both sides of the conveyor so that on the one hand a uniform heating and shrinking is effected in a relatively short time and both sides of the object, if necessary, can be heated.

Preferably laterally of the conveyor there can be at least one heater directed at an acute angle obliquely against the transport direction and a heater directed obliquely in the transport direction of the conveyor so that the heater directed upstream in the transport direction is blowing hot air on the following object while the heater directed downstream in the transport direction continues to heat the preceding object, e.g. the rear of an automobile or the like.

In a preferred embodiment at least one horizontally oriented heater is provided above the conveyor so that for example roof surfaces of an automobile, the windshield, or the hood as well as the upper surfaces of other objects can be individually heated. If necessary the horizontal heater can be vertically adjustable so that it can be custom set to the shape of the object. The height of the heater can also be adjustable.

Here the horizontal heater can be aimed at an acute angle obliquely against and/or into the transport direction of the conveyor so that the same advantages as by the laterally mounted vertical heaters are achieved.

According to the invention at least one of the heaters is subdivided into separate individually adjustable parts so that the heat output can be reduces in particular regions of the object independent of the heat output for the remaining regions of the object. Thus for example with an automobile the heat output can be reduced at the tires and/or side mirrors while the remaining surfaces can be heated normally.

The heaters can each have a gas-burner bar having a part which is of adjustable flow cross section for control so that it is possible to regulate heat output in a simple and technically manner.

Furthermore at least one hot-air extraction system is provided in particular below the conveyor near the heater(s) so that there is no heat buildup that could under certain circumstances result in an undesired and uncontrolled shrinking. In addition heat extractors can be provided at other locations underneath the conveyor or at the heaters.

In a preferred embodiment of the invention the heating is controlled in accordance with the shape and composition of the region being heated, sensors constituted as light curtains being provided to detect the shape and composition. It is also possible to use other types of sensors that detect either the shape or the composition of the objet. Regulation of the heating can for example be done by controlling the heat output of the heater(s) and serves for uniform heating and to avoid overheating the foil and/or the object.

To this end a sensor or light curtain can be provided for each individual region, working in combination with a position detector of the conveyor to determine the instantaneous position fo the region to be protected and to correspondingly control the heating, that is to drop it or return it to the "normal" level.

BRIEF DESCRIPTION OF THE DRAWING

In the following a method according to the invention is described with reference to an apparatus according to the invention shown in the drawing. Therein:

FIGS. 2–4 are top views of various different positions of one of the objects of FIG. 1;

SPECIFIC DESCRIPTION

Figure 1:
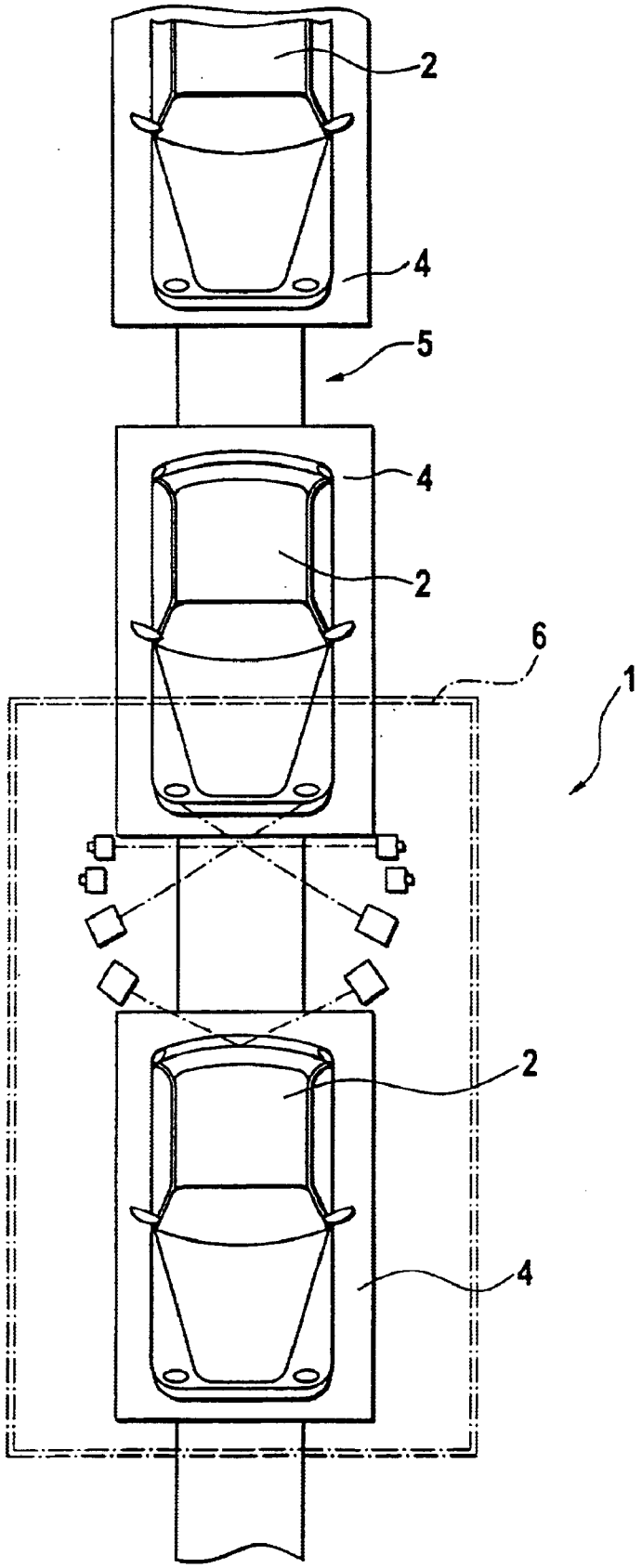
FIG. 1 is a top view of an apparatus according to the invention.
Figure 5:
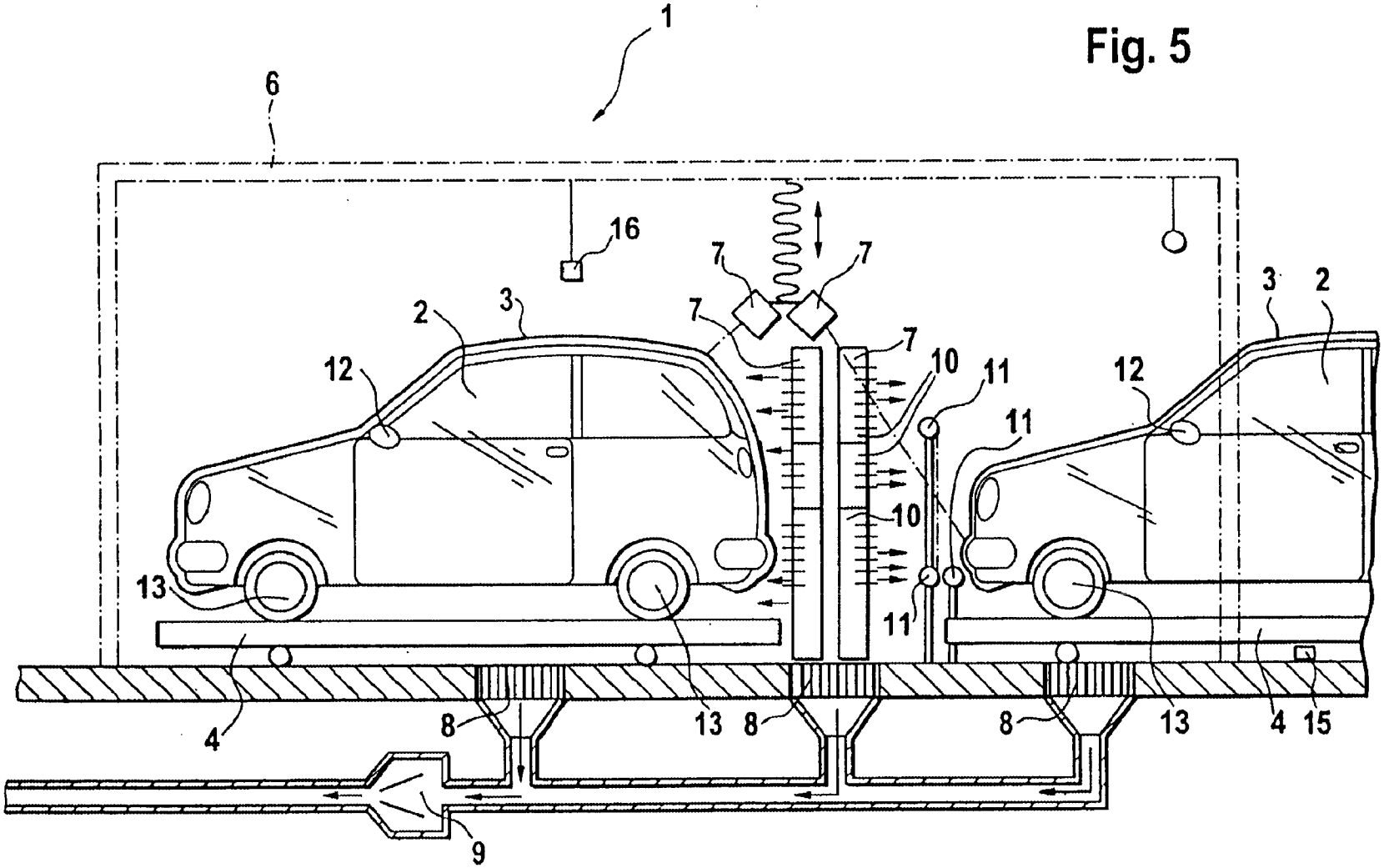
FIG. 5 is a detailed side view of the structure of FIG. 1.
Figure 6:
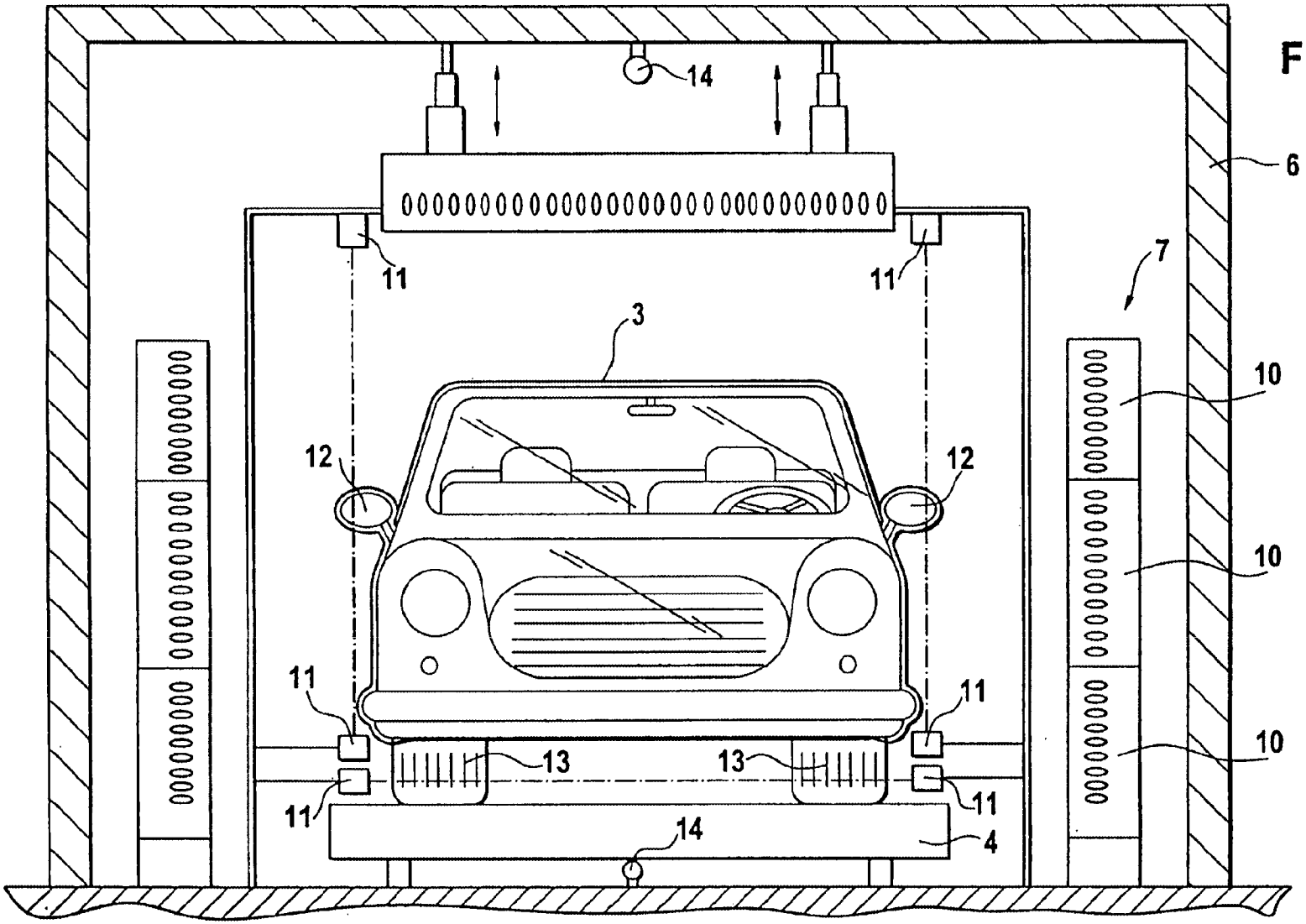
FIG. 6 is a front view of an automobile in an apparatus according to the invention.

In all figures the same or similar parts are identified with the corresponding reference numerals.

FIG. 1 shows an apparatus 1 for the multisided wrapping of automobiles 2 with a heat-shrinkable foil 3 shaped like a hood to fit over the shape of the automobile 2. To this end the automobile 2 covered with the foil 3 sits on a pallet 4 riding on a conveyor 5 through an enclosure 6 of the apparatus 1. The enclosure 6 is provided with heaters 7 set in various orientations and positions.

As visible in FIGS. 2 to 5, there are horizontally as well as vertically directed heaters 7 and these are also directed at an angle to the transport direction of the conveyor 5, either directed in the direction at the automobile 2 they are spaced from or at an automobile 2 that has already passed them. The vertical heaters 7 are to this end set on both sides of the conveyor 5.

Underneath there are exhaust ports 8 connected to a hot-air removal device 9. The horizontal heaters 7 are vertically adjustable and the vertical heaters 7 have several controllable parts 10.

In order to control the effectiveness and thus the coverage of the individual heaters 7 or their parts 10 there are horizontally and vertically oriented light curtains 11 that for example detect the side mirrors 10 or the tires 13 and reduce the outputs of the corresponding heaters 7 according to the transport speed of the conveyor 5, when the side mirror 12 or the tire 13 comes up to zone of effectiveness of one of the heaters 7.

Thus the method according to the invention works as follows: When arriving at the apparatus 1 a light curtain 14 starts the shrink process. The automobile 2 sitting on a pallet 4 and covered by a custom-fitted hood-shaped foil 3 is moved into the apparatus 1 and the unillustrated blowers of the vertical upstream heaters 7 and the upstream horizontal heaters 7 are started. The hot-air extraction system 9 is also started. From a predetermined position of the vehicle, which is determined based on the transport speed and when it enters the apparatus 1, the horizontal heater bar 7 moves downward into a preheating position and the gas burners of the heaters 7 start.

The preheating position which extends to shortly in front of the front tires, employs a higher blowing frequency than the subsequent shrinking at the sides and upper surfaces of the automobile 2. The blowing frequency of the horizontal heater bar 7 is set individually and its reversal points are also separately controlled. From an adjustable position which is in particular determined by the height of the automobile, the horizontal heater bar 7 moves into the upper position from which it heats the foil in the region of the roof of the automobile.

In order to protect the tires 13 of the automobile 2, these are detected by the horizontal light curtain 11 and the corresponding parts 10 of the heaters 7 are throttled down by closing an internal flap in the gas feed of the heaters so that the temperature of the output air is reduced. Heat-deflecting plates in the lower regions of the vertical heaters 7 increase the shrinking of the lower edge of the foil 3.

After the automobile has passed the upstream lateral heaters 7 as well as the horizontal heaters, the gas burners and the hot-air extraction system 9 inside the device 1 are shut down.

Starting in a predetermined position of the automobile 2 the blowers of the downstream vertical heaters 7 as well as the hot-air extraction system 9 are turned on. After the rear tires 13 have moved past these heaters 7, the gas burners are started and the foil 3 on the rear part of the automobile is heated. The conveyor 5 has a pulse generator 15 that emits a pulse every 5 mm of transport so that it is possible to accurately dose the heating of the various regions of the automobile 2. A temperature sensor 16 in the apparatus determines the temperature there in order to trigger any necessary corrections to the heating. Since the transport speed can be varied, it is automatically monitored and the heat output of the heaters 7 is varied depending on the transport speed.

What is claimed is:

1. A method of shrinking a heat-shrinkable hood-shaped foil covering an object, the method comprising the steps of:

displacing the object covered by the foil along a generally straight path in a transport direction past a stationary heater;

directing the stationary heater at an acute angle to the direction;

detecting the position of the object relative to the heater as it passes the heater in the direction; and projecting heat from the heater at the acute angle to the direction at the object as it passes at a rate varied in accordance with the detected position of the object relative to the heater.

2. The foil-shrinking method defined in claim 1 wherein the heating rate is reduced when the object is relatively close to the stationary heater.

3. The foil-shrinking method defined in claim 1 wherein the heating rate is varied also in accordance with the shape of the object.

4. The foil-shrinking method defined in claim 1 wherein the heating rate is varied also in accordance with the composition of the object.

5. An apparatus for shrinking a heat-shrinkable hood-shaped foil around an object, the apparatus comprising:

a stationary heater directed at an acute angle to a transport direction;

conveyor means for displacing the object covered by the foil in transport direction alone a generally straight path past the stationary heater;

means for detecting the position of the object relative to the heater as it passes the heater in the direction; and control means connected between the means for detecting and the stationary heater for projecting heat from the heater at the acute angle to the direction at the object as it passes at a rate varied in accordance with the detected position of the object relative to the heater.

6. The foil-shrinking apparatus defined in claim 5 wherein the heater is vertical and adjacent the conveyor.

7. The foil-shrinking apparatus defined in claim 6 wherein there are two such vertical heaters flanking the conveyor and both connected to the control means.

8. The foil-shrinking apparatus defined in claim 6 wherein there are two such vertical heaters, one directed at an acute angle in the transport direction and the other directed at an acute angle against the transport direction.

9. The foil-shrinking apparatus defined in claim 5 wherein the heater is horizontal and adjacent the conveyor.

10. The foil-shrinking apparatus defined in claim 9 wherein the horizontal heater is vertically adjustable.

11. The foil-shrinking apparatus defined in claim 9 wherein the horizontal heater is directed at an acute angle in the transport direction.

12. The foil-shrinking apparatus defined in claim 9 wherein the horizontal heater is directed at an acute angle against the transport direction.

13. The foil-shrinking apparatus defined in claim 5 wherein the heater is subdivided into a plurality of parts of individually controllable heating rate, the control means being connected to the individual parts for individually controlling the heating rates thereof in accordance with detected position of the object relative to the heater.

14. The foil-shrinking apparatus defined in claim 5, further comprising the step of:

extracting hot air from a location in the conveyor adjacent the heater.

15. The foil-shrinking apparatus defined in claim 14 wherein the hot air is extracted downward through a floor of the conveyor.

16. The foil-shrinking apparatus defined in claim 5 wherein the means for detecting includes at least one light curtain.

* * * * *